United States Patent [19]

Skelly

[11] Patent Number: 4,832,552

[45] Date of Patent: May 23, 1989

[54] METHOD AND APPARATUS FOR ROTARY POWER DRIVEN SWIVEL DRILLING

[76] Inventor: Michael Skelly, P.O. Box 2687, Pampa, Tex. 79066

[21] Appl. No.: 897,607

[22] Filed: Aug. 18, 1986

Related U.S. Application Data

[62] Division of Ser. No. 629,263, Jul. 10, 1984, abandoned.

[51] Int. Cl.[4] ..... E21B 19/14

[52] U.S. Cl. ..... 414/22.54; 173/164; 175/52; 414/22.52

[58] Field of Search ..... 173/164; 175/52, 85, 175/57.16, 57.2, 57.34; 166/77.5; 414/22

[56] References Cited

U.S. PATENT DOCUMENTS

| | | | |
|---|---|---|---|
| 2,450,934 | 10/1948 | Calhoun | 166/77.5 |
| 2,737,839 | 3/1956 | Paget | 81/57.34 |
| 2,760,392 | 8/1956 | Paget | 81/57.16 |
| 3,464,507 | 9/1969 | Alexander et al. | 175/85 |
| 3,655,071 | 4/1972 | Langowski et al. | 414/22 |
| 4,172,684 | 10/1979 | Jenkins | 414/22 |
| 4,347,028 | 8/1982 | Dugan | 414/22 |
| 4,403,666 | 9/1983 | Willis | 175/85 |
| 4,604,724 | 8/1986 | Shaginian et al. | 175/52 |

*Primary Examiner*—Frank T. Yost

*Assistant Examiner*—James L. Wolfe

*Attorney, Agent, or Firm*—Stanley R. Moore; Thomas L. Cantrell

[57] ABSTRACT

The power drive system of the present invention provides a rotary drive swivel unit which can be tilted along its horizontal pivotal axis until its output shaft is substantially horizontal. A drill pipe provided in a substantially horizontal bed adjacent to the drilling rig is aligned with the output shaft of the rotary drive swivel unit and this joint is made up. The rotary drive swivel unit is raised and the suspended drill pipe reoriented to a vertical position and is aligned over the drill string and added thereto substantially at platform level. The power drive system turns the drill string and advances the drilling downhole. The rotary drive swivel unit disengages from the drill string and the foregoing steps are repeated. A drill pipe handling device for aligning substantially horizontal drill pipe with the output shaft of the rotary drive swivel unit is also disclosed and other attributes and equipment which facilitate automated drilling operations are disclosed, including a device for automatically tilting the power swivel drive, an automated drill pipe handling device, a device for placing drill pipe within the handling device and a device for providing additional torque at make up.

4 Claims, 9 Drawing Sheets

12
12
Tank concrete pumps of post.
Fork

METHOD AND APPARATUS FOR ROTARY POWER DRIVEN SWIVEL DRILLING

This is a division of application Ser. No. 629,263, filed July 10, 1984, now abandoned.

BACKGROUND OF THE INVENTION

Rotary drilling operations have long been preferred for drilling deep wells such as for oil and gas applications. The most predominant approach for rotary drilling is to provide a power driven rotary table in a drilling platform through which a Kelly bar slidingly engages to permit vertical movement. The Kelly bar is attached to the drill string. Revolutions of the rotary table drive the Kelly bar which slips through the rotary table with the advancement of the bit at the end of the drill string. This system has the advantage that the machinery for ultimately turning the drilling string can be placed on the platform itself. However, this equipment is heavy and cumbersome and is not portable in the conventional sense. Further, this system requires extensive set up and take down.

An alternative driving unit for rotary drilling has been to dangle a rotary drive from a hook at the end of a block line of a drilling rig. However, these attempts for rotary power driven swivels have produced power drive systems which are heavy and cumbersome and preclude reorienting the vertical axis of the output shaft or saver-sub for connection to drill pipe in an orientation other than vertical alignment. Thus, each piece of the drill pipe must be vertically aligned for the convenience of the power drive unit. This requires relatively extensive handling to either stand the pipe on its end within the drilling rig by snaking the pipe up among the cross bars or, alternatively, to vertically stand the drilling pipe by dropping it into a "mouse hole" adjacent the drilling rig, again requiring that the pipe be lifted and then set down in separate operations from that of attaching or making up the power drive system to the drill pipe.

It is an object of the present invention to provide a portable drive system capable of rapid set up in support of the drilling rig for both drilling a well and for reworking a well.

Another object of the present invention to provide a rotary power drive for drilling or reworking oil wells which is suspendable upon a block line of a drilling rig, yet is capable of making up with a substantially horizontal drill pipe, thereby eliminating time consuming and awkward orientation of the drilling pipe to a vertical position prior to make up.

It is a further object of the present invention to increase the ease of handling and safety for power drive systems suspended from the block line of a drilling rig.

Finally, it is an object of the present invention to automate drilling operations.

SUMMARY OF THE INVENTION

The present invention is a power drive system for imparting rotary motion to a drill string for the drilling of deep wells, such as for oil and gas applications. The power drive system of the present invention attaches to the traveling block suspended from a derrick of a drilling rig.

The heart of the power drive system is a rotary drive swivel unit which provides the drive means for imparting rotary motion to the drill string. The rotary drive swivel unit is connected to the traveling block of the drilling rig by means providing a horizontal pivotal axis about which the rotary drive swivel unit can tilt, this horizontal pivotal axis being substantially adjacent to the center of gravity for the rotary drive swivel unit.

Means for resisting the torque upon the rotary drive swivel unit when the latter is turning the drill string are connected to the rotary drive swivel unit.

Construction of a power drive system in accordance with the present invention provides a rotary drive swivel unit which can be tilted along its horizontal pivotal axis until its output shaft or saver-sub is substantially horizontal. A drill pipe provided in a substantially horizontal bed adjacent the drilling rig is easily aligned with the output shaft of the rotary drive swivel unit and this joint is conveniently and safely made up. The rotary drive swivel unit is then raised in the derrick by the traveling block and the weight of the drill pipe suspended therefrom reorients the rotary drive swivel unit which tilts to its normal vertical position.

The depending second end of the drill pipe is then in alignment over the drill string and the drill pipe is added thereto with this connection being made substantially at platform level. Means for resisting the torque upon the rotary drive swivel unit is provided and permits torque to be transmitted from the power drive system to turn the drill string and advance the drilling until the last added drill pipe has been substantially advanced downhole. At this point, the rotary drive swivel unit is approaching platform level and it is disengaged from the end of the drill string and is ready to be tilted for alignment with another horizontally approaching drill pipe. The foregoing steps are repeated and drilling advances with the addition of another drill pipe to the drill string.

Also disclosed is a drill pipe handling device for aligning substantially horizontal drill pipe taken from the bed with the power output or saver-sub of the rotary drive swivel unit. This device power lifts the end of the drill pipe to the tilted rotary drive swivel unit to provide for quick make up.

The present invention permits use of very portable equipment and reduces the handling of drill pipe otherwise necessary. Further, that handling of the drill pipe which is still necessary is done at more accessible work areas, that is within reach on the platform. The present invention also includes attributes which facilitate automated drilling operations including means for automatically tilting the power swivel drive, an automated drill pipe handling device, means for placing drill pipe within the handling device and means for providing additional torque at make up.

DETAILED DESCRIPTION OF THE DRAWINGS

Figures 1, 2:
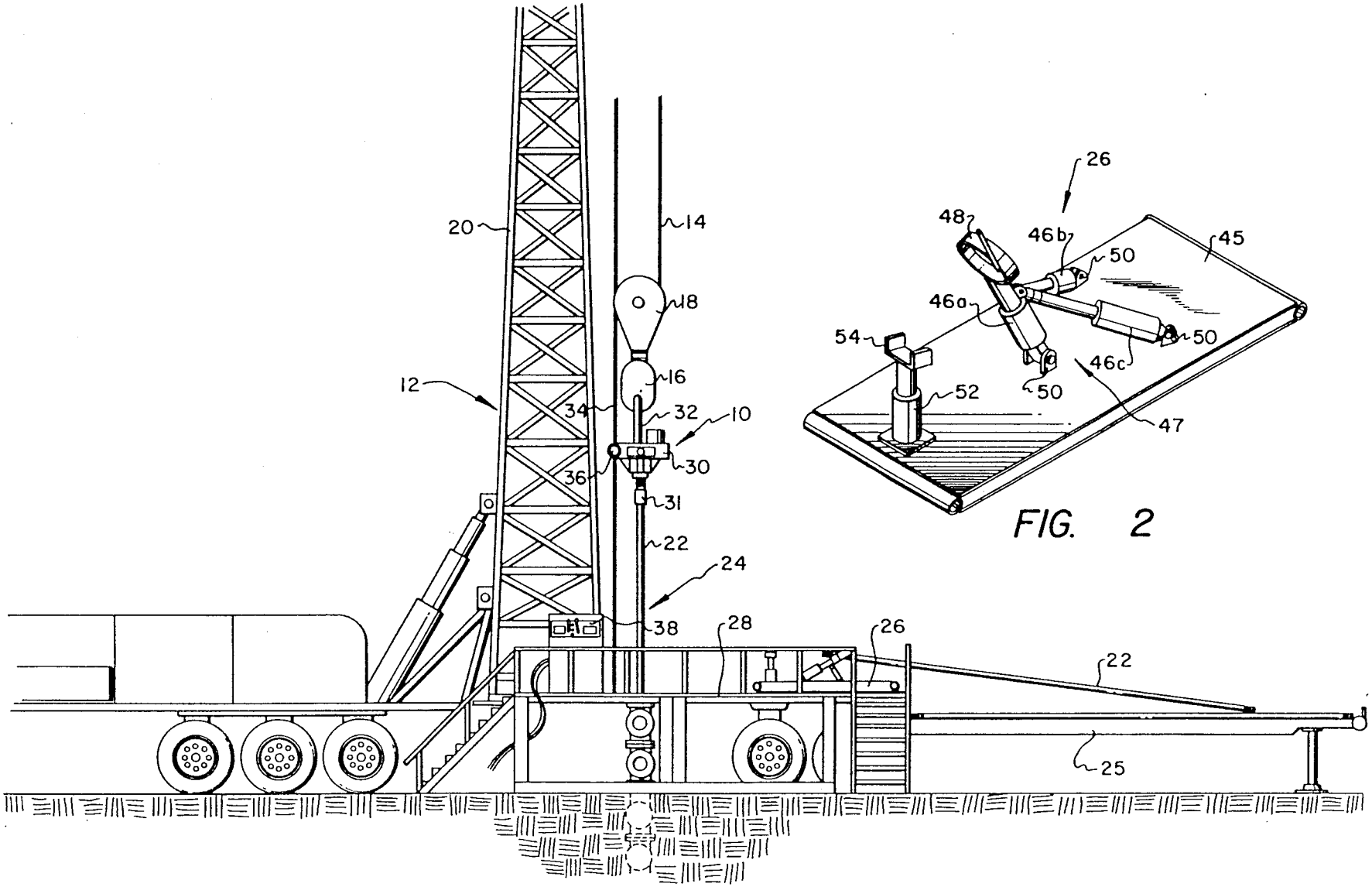
FIG. 1 is a side elevational view of a drilling rig incorporating the power drive system of the present invention.
FIG. 2 is a perspective view of a drill pipe handling device constructed in accordance with the present invention.

FIG. 1 illustrates power drive system 10 in place on drilling rig 12 suspended at the end of block line 14 upon hook 16 attached to traveling block 18. Block line 14 is suspended from the top of derrick or mast 20 by conventional means not illustrated. Drilling pipe 22 is provided adjacent drilling rig 12 on a substantially horizontal bed 25. One of drilling pipes 22 is illustrated connected to power drive system 10 as a part of drill string 24. Another drilling pipe 22 is shown ready for attachment to power drive system 10 as it is oriented in pipe handling device 26 positioned on drilling platform 28.

Power drive system 10 is illustrated in FIG. 1 with a rotary drive swivel unit 30 attached to hook 16 through bail 32. The output shaft 31 of rotary drive swivel unit 30 connects the power drive system to drill string 24. Torque arrest line 34 provides resistance to the torque developed by rotary drive swivel unit 30 in turning drill string 24. Torque arm 36 which is attached to the rotary drive swivel unit slidingly engages torque arresting cable 34.

Controls 38 determine the speed and direction of rotation for rotary drive swivel unit 30.

Figure 3:
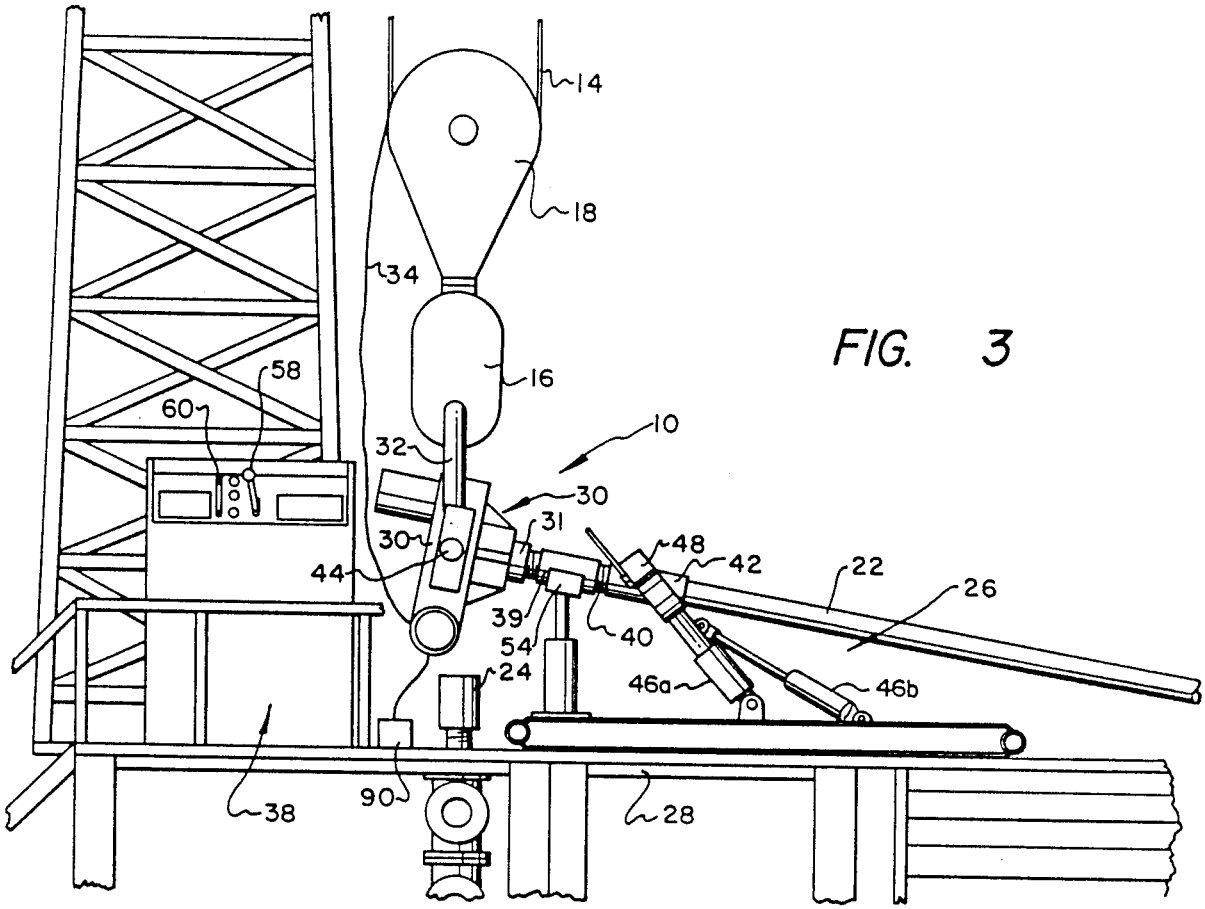
FIG. 3 is a side elevational view of a power drive system constructed in accordance with the present invention.
Figure 4:
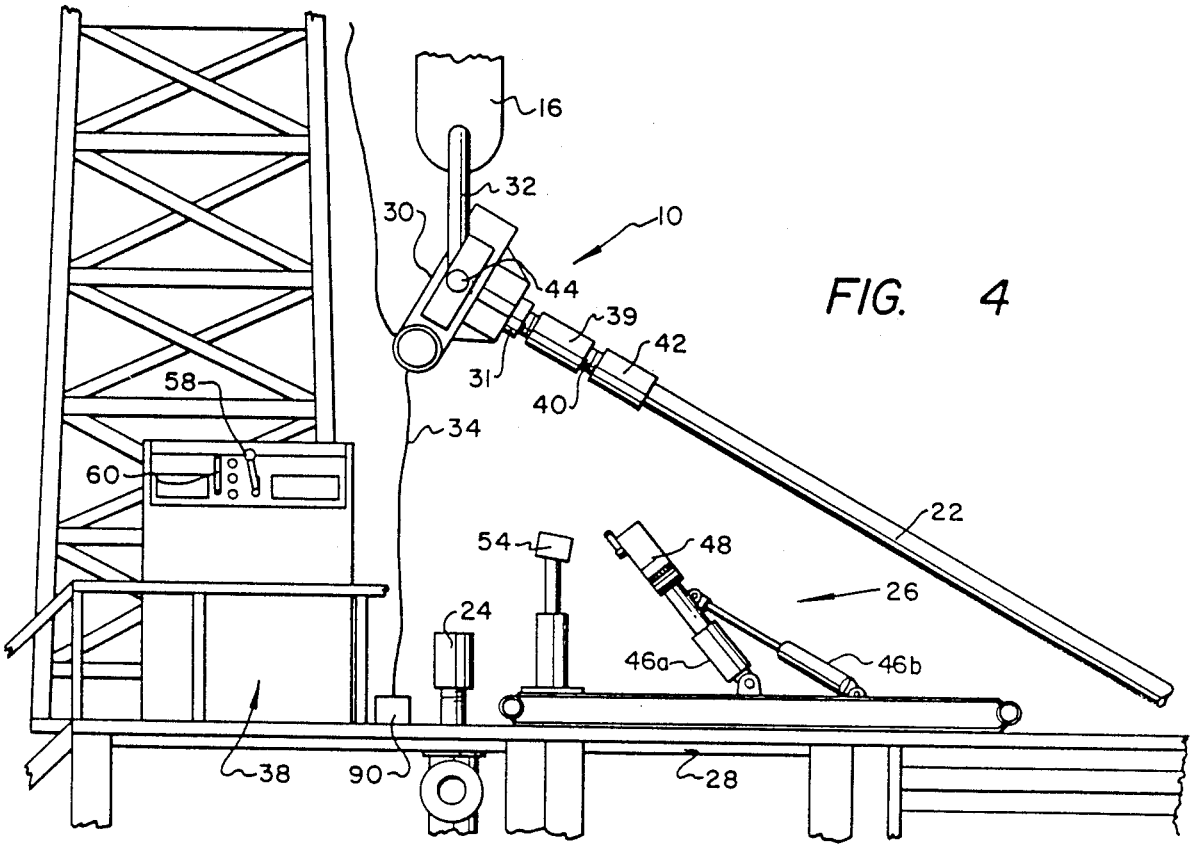
FIG. 4 is a side elevational view of a power drive system constructed in accordance with the present invention.

FIGS. 3 and 4 illustrate the use of the present invention in making up connection between rotary drive swivel unit 30 and drilling pipe 22. In this embodiment, output shaft 31 of rotary drive swivel unit 30 is extended by mating with the female end of a saver-sub 39 which presents a male threaded portion 40 of output shaft 31 sized to threadingly engage drill pipe collar 42 of drill pipe 22.

FIGS. 3 and 4 show various stages of connecting a drill pipe 22 to power drive system 10 and preparations for connecting the other end of drill pipe 22 to drill string 24 presented above platform 28.

For make up, block line 14 is lengthened dropping traveling block 18 and hook 16, depending therefrom. In the preferred embodiment, power drive system 10 is attached to traveling block 18 by bail 32 connected with hook 16.

Bail 32 attaches to rotary drive swivel unit 30 at bail mounts 44 on opposing sides of the rotary drive swivel unit. The connection of bail 32 at bail mounts 44 is a pivotal connection which establishes a horizontal pivotal axis.

In FIG. 3, torque arresting cable 34 has been slackened and rotary drive swivel unit 30 has been pivoted about its horizontal pivotal axis to present output shaft 31 in a substantially horizontally orientation for make up with a horizontally approaching drill pipe 22.

Another aspect of this invention is pipe handling device 26 which aids in aligning drill pipe collar 42 of pipe 22 with output shaft 31 for make up and providing for a make up in which it is not necessary for people to hold either of the elements of rotating machinery.

FIG. 2 illustrates the preferred embodiment of pipe handling device 26. The basic elements of the pipe handling device are base or skid 45 and means 47 mounted thereon for orienting drill pipe 22. In the preferred embodiment, orienting means 47 consists of three hydraulic cylinders 46*a*, 46*b* and 46*c*, each of which are connected to collar 48 at one end and mounted to base 45 through a trunion 50 on the other end. Further, in the preferred embodiment, power control of the position of output shaft 31 is achieved by a fixed mounted cylinder 52 attached at one end to base 45 and providing a output shaft engaging collar 54 on the other end. Returning to FIG. 3, rotary drive swivel unit 30 has been disengaged from drill string 24 which is now in close proximity to the level of drilling platform 28 and the rotary drive swivel unit has been rotated upon its horizontal pivotal axis provided through bail mount 44. The output shaft of the tilted rotary drive swivel unit has been secured upon collar 54 of pipe handling device 26 and one of drill pipes 22 has been placed with the drill pipe collar 42 in collar 48 of pipe handling device 26. The hydraulics in the respective cylinders 46*a*, 46*b* and 46*c* then lift the end of drill pipe 22 into position for making up with the output shaft of rotary drive swivel unit 30. In the embodiment of FIGS. 3 and 4, saver-sub 39 is a part of the output shaft.

The means 38 for controlling the rotary drive swivel unit has two major controls, speed control lever 58 and directional control lever 60. Controls are set to slowly advance the rotation of rotary drive swivel unit for the output shaft 31 of rotary drive swivel unit 30 to achieve make up with drill pipe 22. It is particularly advantageous that this make up can be accomplished where all the parts are accessible, yet provide for make up which is automized to the extent that it is not necessary for operators to be directly involved in manual operations grasping the moving machinery.

Once make up is accomplished, block line 14 is taken up and rotary drive swivel unit 30 is raised, pivoting about bail mounts 44 as it rises. Please refer to FIG. 4. Thus, drill pipe 22 and the output shaft of rotary drive swivel unit 30 both leave pipe handling device 26 and the end of drilling pipe 22 is drawn across drilling platform 28 as rotary drive swivel unit 30 is elevated.

At full elevation, drill pipe 22 depends vertically from rotary drive swivel unit 30 directly over the uppermost extremity of drill string 24. Drill pipe 22 is then slightly lowered and the threaded surfaces of drill pipe 22 engage the threaded surfaces of drill string 24.

The torque arresting cable is then drawn taut and conventional means such as tongs are placed around drill string 24 to secure it in place while slow rotation is applied to drill pipe 22 through rotary drive swivel unit 30 until drill pipe 22 makes up with drill string 24 to become part of the drill string. Means arresting rotation of the drill string are then removed and full torque is applied to drill string 24 from rotary drive swivel unit 30 to rotate the drill string and the bit at the end thereof and thereby advance drilling.

Drilling advances until the upper end of drill string 24 approaches platform 28 again and the process repeats. Torque resisting means are applied to drill string 24 such as conventional tongs to prevent further rotation of the drill string 24 and the direction of rotation is reversed by directional control lever 60. As rotary drive swivel unit 30 reverses the rotation, threaded output shaft 40 disengages from drill pipe collar 42 on the drill string. The tension in torque arresting cable 34 is then lessened to provide for tilting rotary drive swivel unit 30 and the output shaft is placed upon collar 54 and a new drill pipe 22 is positioned for make up.

In the preferred embodiment, means 90 for controlling tension in the torque arresting cable is controlled through controls 38 and employs a hydraulic cylinder (not shown).

Figure 5:
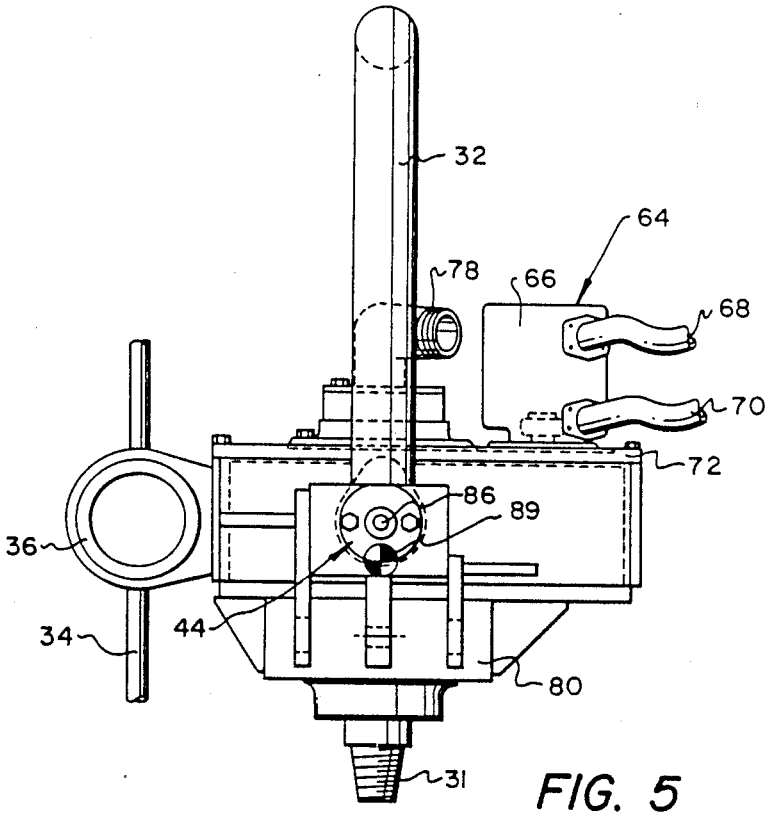
FIG. 5 is a side elevational view of a rotary drive swivel unit constructed in accordance with the present invention.
Figure 6:
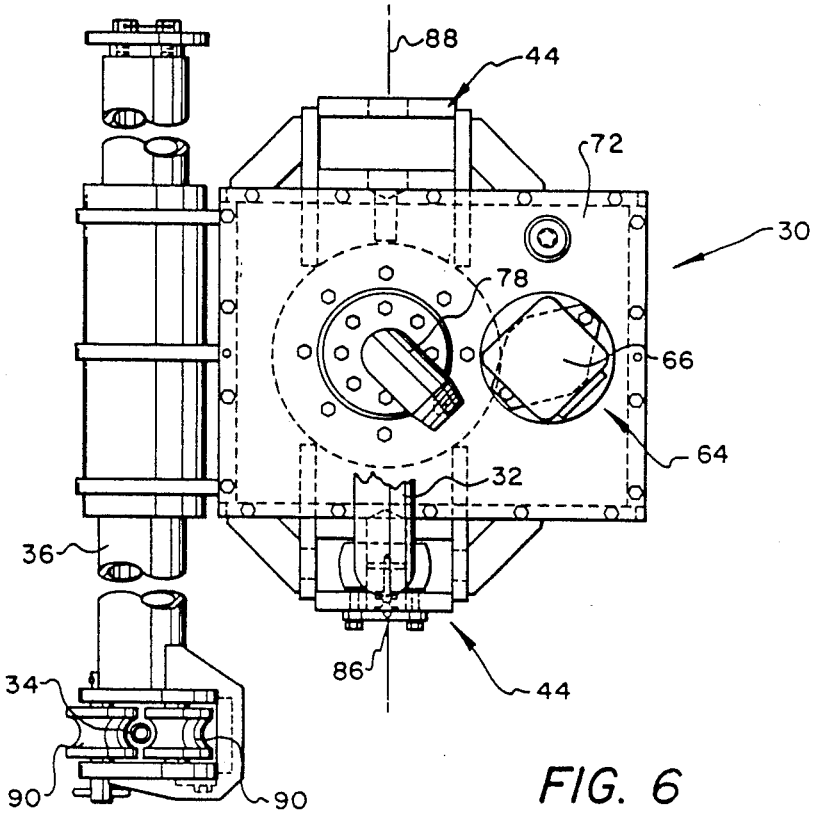
FIG. 6 is a top elevational view of a rotary drive swivel unit constructed in accordance with the present invention.
Figure 7:
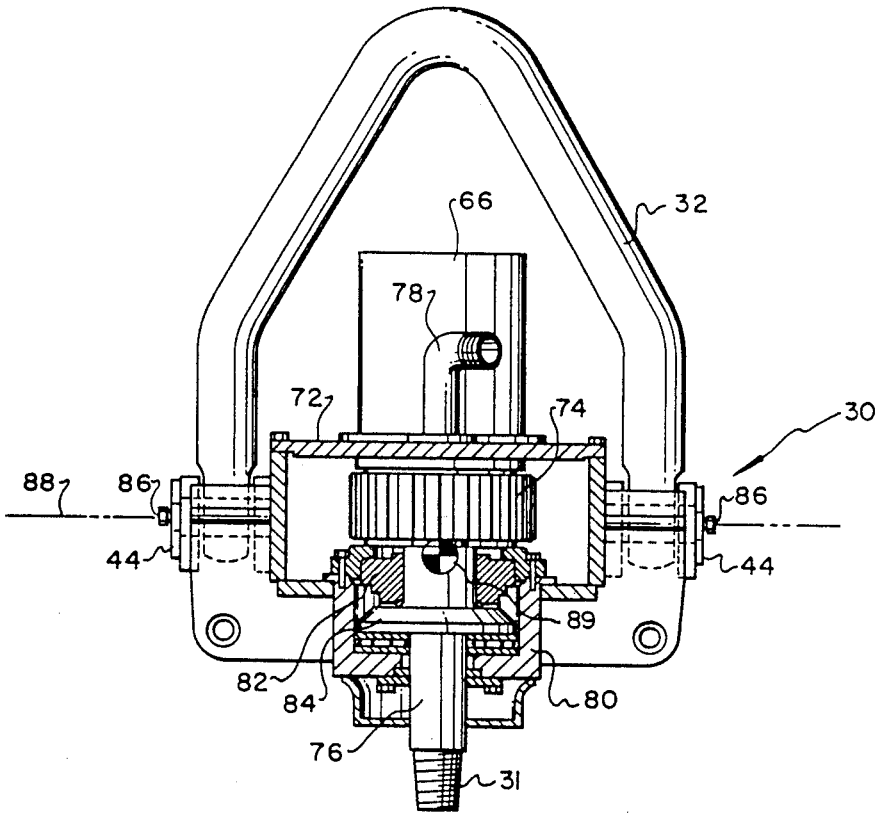
FIG. 7 is a cross section of a rotary drive swivel unit constructed in accordance with the present invention.

FIGS. 5, 6 and 7 illustrate the preferred embodiment of rotary drive swivel unit 30 in greater detail. These figures provide a side elevational view, an overhead elevational view and a cross section of rotary drive swivel unit 30, respectively.

In the preferred embodiment, drive means 64 is provided by hydraulic motor 66 having input and output lines 68 and 70, respectively. See FIG. 5. Hydraulic motor 66 is attached on the top of gear housing 72 substantially off center. The output shaft (not shown) of hydraulic motor 66 projects into gear housing 72 where a pinion gear (not shown) is mounted which drives bull gear 74 within gear housing 72. See the cross section of FIG. 7.

Bull gear 74 is mounted on a hollow shaft 76, one end of which connects to goose neck 78 with a mud conducting connection and the other end of which connects to output shaft 31 of rotary drive swivel unit 30. The output shaft is also hollow and the connection with hollow shaft 76 conducts mud from goose neck 78 into drill string 24 during drilling operations illustrated in FIG. 1.

Beneath gear housing 72 is bearing housing 80 which contains thrust bearings 82 and 84 for resisting both upward and downward thrust, respectively, which will be applied to shaft 76 during drilling applications. See the cross section of FIG. 7. In the preferred embodiment, these thrust bearings interfacing with shaft 76 are each tapered bearings. As discussed above, the ultimate output of rotary drive swivel unit 30 appears at output shaft 20 beneath bearing housing 80.

FIGS. 5 and 6 illustrate the connection of torque arm 36 to gear housing 72. Torque arm 36 spaces rollers 90 from the axis of rotation for output shaft 20. Rollers 90 engage either side of torque resting cable 34 in a manner to permit free vertical running but that will prevent rotation of gear housing 72 in response to torque applied to the drill bit.

FIGS. 5, 6 and 7 also disclose details of the pivotal connection of rotary drive swivel unit 30 to bail 32 which is shown suspended by traveling block 18 illustrated in FIGS. 1, 3 and 4. Portions of bail 32 have been broken away from FIG. 6 to more clearly illustrate the top of the rotary swivel drive unit.

Bail 32 is connected to gear housing 72 through bail mounts 44. This is a pinned connection held by pin 86 at the horizontal pivotal axis which has been designated in FIGS. 6 and 7 with the reference character 88. This permits rotary drive swivel unit 30 to tilt to bring output shaft 31 into a substantially horizontal alignment for make up with substantially horizontal drill pipes as discussed before.

An important feature of the rotary drive swivel unit 30 facilitating tilting for make up is that the center of gravity, designated with reference numeral 89 on each of FIGS. 5 and 7, is positioned very close to pivotal axis 88 about which the rotary drive swivel unit tilts. This proximity of the center of gravity to the pivotal axis provides easy and controlled tilting of the heavy rotary drive swivel unit with a minmum of force.

Figure 8:
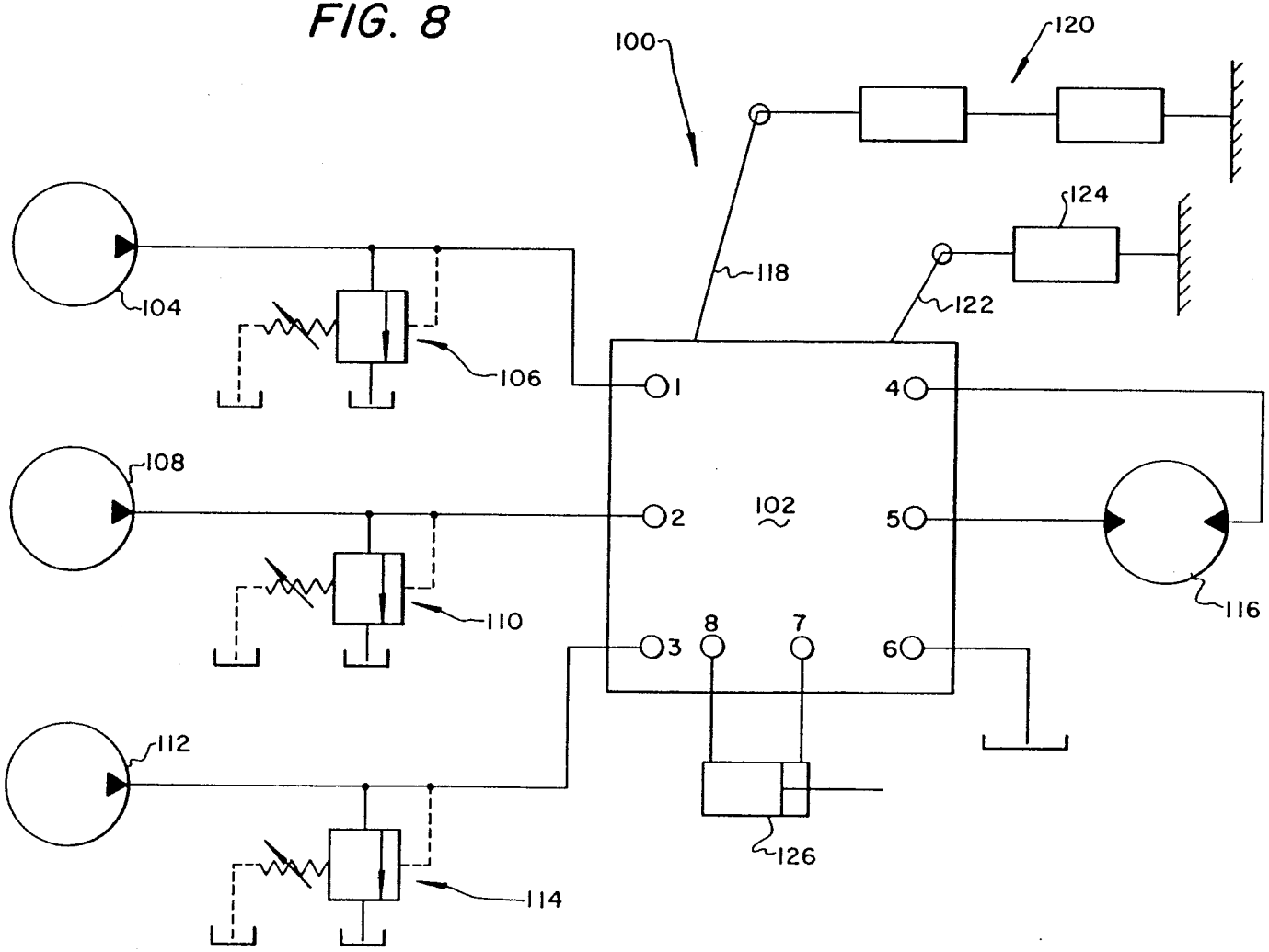
FIG. 8 is a schematic of a control system for the power drive system of the present invention.

FIG. 8 is a schematic representation of hydraulic circuit 100 within the power drive system of the present invention. In this preferred embodiment, the heart of the control system is a multiple flow directional and control valve 102 similar to that disclosed in U.S. Letter Pats. No. 4,330,008 issued May 18, 1982.

Pump 104 is connected to inlet port 1 of valve 102 through pressure relief valve 106. Similarly, pumps 108 and 112 are connected to inlet ports 2 and 3 of valve 102 through pressure relief valves 110 and 114, respectively. In this configuration, the outlet ports of multiple flow and directional control valve 102 have been designated 4, 5, 6, 7 and 8. Outlet ports 4 and 5 are connected to hydraulic motor 116. The hydraulic motor in the schematic is the same means for imparting rotation to the drill string as presented by hydraulic motor 66 in FIG. 5. As discussed above, it is necessary to reverse the direction of rotation of the rotary drive swivel unit to disconnect the power drive means from the drill stem in preparation for adding another drill pipe. Returning to FIG. 8, the direction of rotation for hydraulic motor 116 is actuated through direction control input 122 which is thrown by pneumatic cylinder 124 in the preferred embodiment.

Not only is it necessary to control the direction of rotation in motor 116 but it is also desired to be able to drive the rotary output at different speeds for making up and disconnecting joints and in response to different formations when drilling. The speed of hydraulic motor 116 is a function of the position of speed control input 118 to valve 102. The position of speed control input 118 is determined by cylinder series 120.

Outlet port 6 of valve 102 is connected to the reservior and outlet ports 7 and 8 control auxiliary functions designated here generally with cylinder 126 such as the hydraulic cylinders and the pipe handling device of FIG. 2. Separate inputs (not shown) are applicable for controlling auxillary functions.

Figure 9:
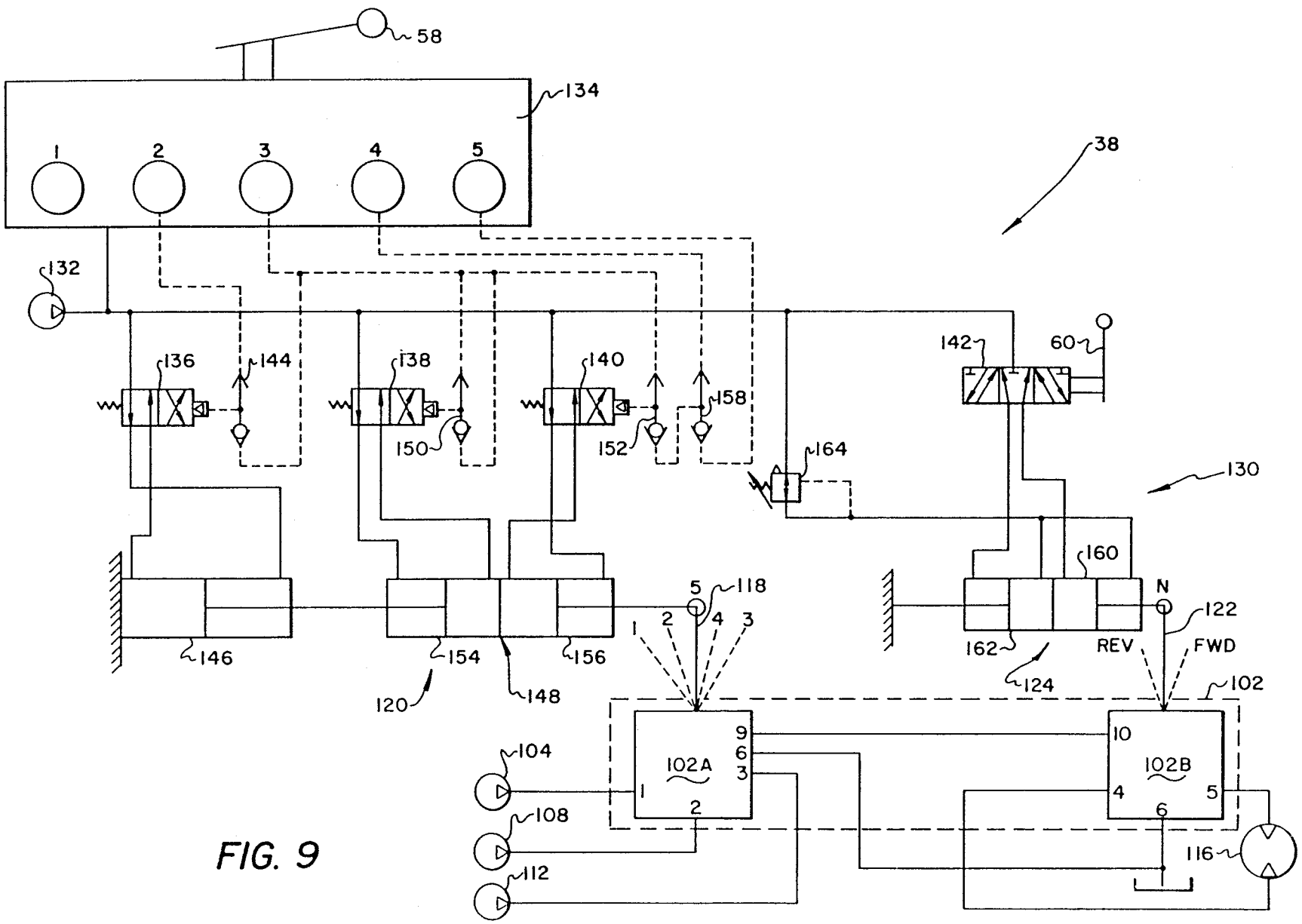
FIG. 9 is a detailed schematic of a control system for the power drive system of the present invention.

FIG. 9 illustrates the preferred embodiment of control 38. In this figure, the hydraulic circuit 100 has been further simplified for illustrative purposes and multiple flow and directional control valve 102 has been separated to a multiple flow valve portion 102A and a directional valve portion 102B. Again, pumps 104, 108 and 112 are connected to inlet ports 1, 2 and 3 of valve 102 and multiple flow valve portion 102A. Outlet port 6 of multiple flow valve 102A returns to the reservior and outlet port 9 is connected to the inlet port of directional control valve 102B.

Five positions of control input 118 for determining the flow rate through 102A and ultimately the speed of motor 116 are illustrated in FIG. 9 and are numbered 1 through 5 in order of increasing speed. In the preferred embodiment, the positions of speed control input 118 do not ascend with speed in a linear progression, rather the pattern of speed to corresponding position is irregular as presented in an order of 1, 2, 5, 4 and 3.

Directional control valve portion 102B has directional control input 122 which is shown moveable between three selected positions, reverse, neutral and forward. Outlet ports 4 and 5 of directional control valve portion 102B are connected to hydraulic motor 116.

Pneumatic logic circuit 130 determines the displacement of pneumatic cylinder series 120 and pneumatic cylinder 124 to position the speed control input 118 and directional control input 122, respectively. The displacement of cylinder series 120 and double cylinder 124 are functions of the input from speed control lever 58 and directional control lever 60, respectively, which are also illustrated on the instrument panel of FIGS. 3 and 4.

Pump 132 provides pneumatic fluid under pressure to actuate pneumatic logic circuit 130. Pump 132 is connected to five position valve 134; two position, four-way valve 136; two position, four-way valve 138; two position, four-way valve 140; and directional control valve 142. A suitable five position control valve is marketed by WABCO as a Controlair ® valve.

Outlet port 1 of five-way valve 134 does not forward any pneumatic signal and the resulting position of speed control input 118 has been designated with the number "1" as actuated through pneumatic cylinders series 120. This input at speed control input 118 produces the lowest speed in motor 116 through multiple flow and directional control valve 102.

Outlet port 2 of five position valve 134 is connected to the pilot of two position, four-way valve 136 through shuttle valve 144. When speed control lever 58 is in the position which opens outlet port 2 of five position valve 134, a signal is transmitted through shuttle valve 144 which actuates valve 136 to throw cylinder 146 its designated length. One end of cylinder 146 is fixed while the piston rod is connected to control input 118 through double cylinder 148.

Placing speed control lever 58 in a position which opens outlet port 3 sends a signal to valve 136 through shuttle valve 144, valve 138 through shuttle valve 150 and valve 140 through shuttle valve 152. These respective signals place speed control input 118 in the position designated with reference "3" by the action within the cylinder build up cylinders 120 as valve 136 opens to throw cylinder 146 its designated length, valve 138 opens to throw cylinder 154 of double cylinder 148 and valve 140 opens to throw cylinder 156 its designated length.

Placing the speed control lever in a position which opens outlet port 4 of five positioned valve 134 sends a pneumatic signal to valve 138 through shuttle valve 150 and to valve 140 through shuttle valves 158 and 152. Valve 138 then opens to throw cylinder 154 its designated length and valve 140 simultaneously throws cylinder 156 its designated length, but cylinder 154 is not thrown. This produces a cylinder build up which places speed control input 118 in the position designated with reference numeral "4".

Finally, when outlet port 5 is opened by the positioning of speed control lever 58, a pneumatic signal is sent only to valve 140 through shuttle valves 152 and 158. Valve 140 opens and cylinder 156 is thrown its length and neither cylinder 146 nor 154 contribute by extension to the preslected cylinder build up which brings speed control input 118 to the position designated with the reference numeral "5".

In the preferred embodiment, the designated throw of cylinder 146 is approximately twice that of either pneumatic cylinders 154 or 156.

The throws of cylinders 146, 154 and 156 are functions of the position of speed control lever 58 and translate regular, sequential speed input by manipulation of lever 58 into the irregular progression of speed control input 118 which is necessary to use the multiple flow and directional control valve 102 of the preferred embodiment.

Pneumatic pump 132 is also connected with each of cylinders 160 and 162 of double cylinder 124 through pressure release valve 164. Directional control lever 60 actuates valve 142 that controls cylinders 162 and 160 of double cylinders 124. The piston rod of cylinder 162 is fixed and the relative positions of cylinders 160 and 162 as selected with lever 60 produce three positions for directional control input 122 which operate with the directional control valve portion 102B of multiple flow and directional control valve 102 to select reverse, neutral and forward modes of operation for motor 116.

Figures 10, 11, 12:
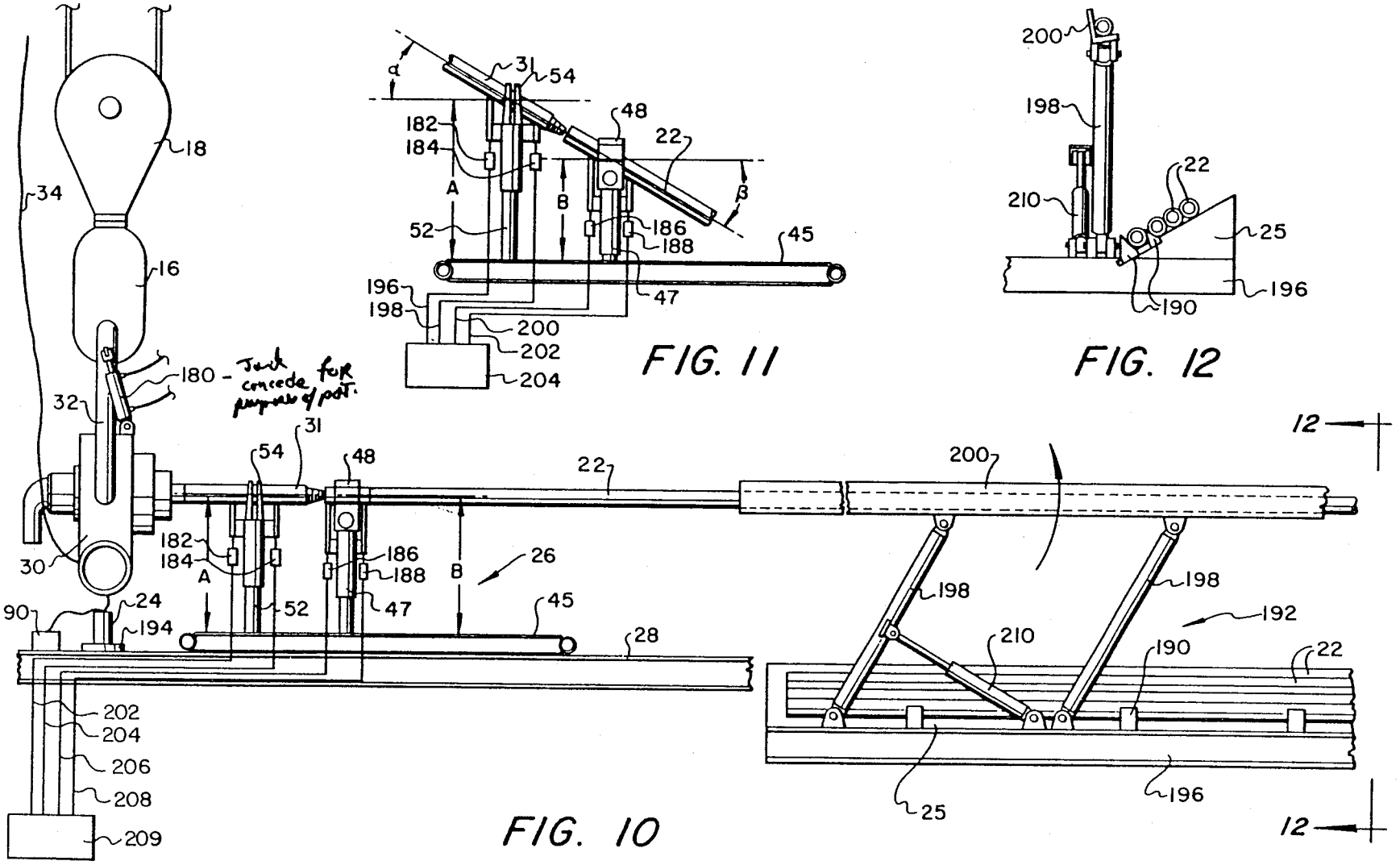
FIG. 10 is a side elevational view of a rotary drive swivel unit during automated alignment for make up including a drill pipe lifting device constructed in accordance with the present invention.
FIG. 11 is a side elevational view of a rotary drive swivel unit and drill pipe handling device during automated alignment for make up in accordance with the present invention.
FIG. 12 is an end elevational view of the drill pipe lifting device of FIG. 10 as taken along line 12—12 of FIG. 10.

FIG. 10 illustrates an embodiment of the present invention providing for greater automation of of drilling operations. Drilling operations continue until power swivel drive 30 approaches the level of platform 28 as was discussed with respect to FIGS. 1, 3 and 4. When power swivel drive 30 approaches the platform and most of the drill string has been been advanced downhole, hydraulic motor 116 (see FIG. 9) is placed in neutral and drill stem 24 is grasped between permanently placed slips 194 which, in this embodiment incorporate tongs. The hydraulic motor is then shifted to reverse in a low speed of rotation which unscrews output shaft 31 from engagement with drill string 24.

Once power swivel drive 30 is disengaged from the drill string it is shifted to neutral and is slightly raised.

Power drive swivel 30 of FIG. 10 pivots by operation of hydraulic cylinder 180 attached between bail 32 and the gear housing of power drive swivel 30. Further, the contraction of cylinder 180 is linked with the slackening of torque arrest cable 34 through means for controlling the torque line tension 90. The power swivel drive unit is then lowered to rest on collar 54.

Cylinder 52 presents collar 54 which supports output shaft 31 and, in this embodiment, is provided with two sensors, sensors 182 and 184. A single hydraulic cylinder, means 47 for orienting the drill pipe is also mounted to base or skid 45. Hydraulic cylinder 47 presents collar 48 for receiving drill pipe 22. Two sensors are also provided with respect to collar 48 of hydraulic cylinder 47, sensors 186 and 188.

Feed means 190 within bed 25 presents single drill pipes 22 to scissors lifting device 192 which lifts a drill pipe to the approximate height for reception within collar 48. See FIGS. 10 and 12. Scissors lifting device 192 rests on base 196 which supports slanted bed 25 upon which a supply of drill pipes 22 has been loaded. Parallel lift arms 198 are also pivotally connected to the base on one end. The lift arms are pivotally mounted to cradle 200 on the other end and lifting means such as hydraulic cylinder 210 is connected between the base and one lift arm to drive the cradle on an upward and forward arch toward position for make up. Dropping the lower release of feed means 190 allows a drill pipe to roll onto cradle 200 in its lowered position. After the lower release is returned, the upper release is shifted to advance the next drill pipe to loading position and the upper release again locks to retain all but the next drill pipe as the last proceeding drill pipe is made up.

As discussed above, drill pipe 22 is brought to rest upon collar 48 of pipe handling device 26. Each of collars 54 and 48 are carried upon hydraulic cylinders over base 45. Sensors 182 and 184 work in cooperation with 186 and 188 in order to coordinate the approach of drill pipe 22 to threaded portion 40 of output shaft 32 as extended by saver-sub 39 as each are supported in pipe handling device 26. When alignment is achieved, the hydraulic motor of rotary drive swivel unit 30 is shifted for a low speed forward rotation and the connection of output shaft 31 to drill pipe 22 is made up. Then rotary drive swivel unit 30 is shifted to neutral and is raised, thereby suspending drill pipe 22 therefrom as it translates to a vertical orientation over drill string 24.

The rotary drive swivel unit is then slightly lowered and drill pipe 22 is driven in low forward speed by the hydraulic motor of the rotary drive swivel unit in order to make up with the drill string. Again, slips incorporating permanent tongs 194 grasp the drill string while this drill pipe 22 and drill string 24 rotate together.

Once the joint is made up, a proper speed for drilling is determined based upon conventional geological criteria.

Returning to the make up of the output shaft with the drill pipe, sensors of the preferred embodiment aid in aligning both the angle of approach and the relative height of the drill pipe and output shaft as discussed further below.

When scissors pipe lifting device 192 is used, it is most convenient to set the height at which collar 54 will grasp output shaft 31 equal to the height at which drill pipe 22 is set above base 45 of pipe handling device 26. These distances are set out in FIGS. 10 and 11 as distance A and distance B, respectively.

When height A is equal to height B, alignment for make up is proper when both output shaft 31 and drill pipe 22 are substantially horizontal. Sensors 182 and 184 measure the relative angle of saver-sub 38 with respect to the horizontal. See FIG. 11 where this angle has been designated $\alpha$ (alpha). Similarly, sensors 186 and 188 measure the angle of drill pipe 22 to the horizontal as has been designated with the reference character $\beta$ (beta). The angles are exaggerated for better illustration in FIG. 11. Thus a true horizontal alignment for make up is achieved when height A equals height B and the summation of angle $\alpha$ (alpha) and angle $\beta$ (beta) is zero or angle $\alpha$ (alpha) equals angle $\beta$ (beta) equals zero as illustrated in FIG. 10. Conventional summing equipment 209 is available to determine this condition pneumaticly, hydraulicly, electricly and/or mechanicaly through lines 202, 204, 206, and 208. When alignment is achieved, slow rotation is imparted to output shaft 31 and the drill pipe is brought into contact therewith and screwed into place in the embodiment of these figures.

Alternatively, if scissors lifting device 192 is not used, case collar 48 of pipe handling device 26 which rests on platform 28 will be higher than bed 25. See FIG. 11. In this case angle $\beta$ (beta) will have a value greater than zero and distance A must be controlled to be greater than distance B. The first make up is made by hand and sighted by eye. Angle $\beta$ (beta) is measured and angle $\alpha$ (alpha) will be set to zero the readout in summing equipment 209 when it equals angle $\beta$ (beta). Conventional readout for operations includes the use of gages for visual needle alignment and "go-no go" red and green light configurations.

In both instances, alignment in the other two planes is manually preset and should not change during an entire drilling operation.

Figure 15:
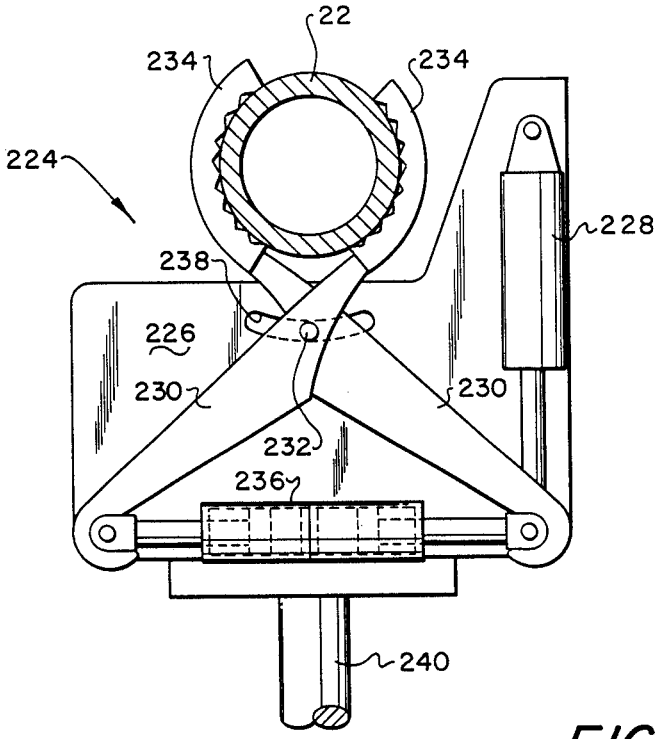
FIG. 15 is a end elevational view of a power wrench assembly of an automated drill pipe handling device taken along line 15—15 of FIG. 13.

An other embodiment of drill handling device 26 provides for additional torque during make up over that provided by the power swivel drive unit by using power wrenches 224, one of which is illustrated in FIG. 15.

Power wrench 224 has a wrench base 226 to which wrenching cylinder 228 is pivotally connected. The other end the wrench cylinder is pivotally connected to one of two tong arms 230. The tong arms are pivotally connected together at tong pivot 232 and extend to form jaws 234.

Gripping cylinders 236 are pivotally connected between the extending ends of tong arms 230. Tong pivot 232 slideably engages base 226 in an arcuate slot 238.

In operation, gripping cylinders 236 expand, spreading tong arms 230 which in turn close jaws 234 about drill pipe 22. After the jaws have engaged the drill pipe, expansion and contraction of wrenching cylinder 228 will impart rotation to output shaft 31. At the end of the power stroke of wrenching cylinder 228, gripping cylinders 236 contract and jaws 234 release the output shaft. A return stroke of wrenching cylinder 228 turns jaws 234 to position for engagement for another torque transmiting stroke of cylinder 228.

Figure 13:
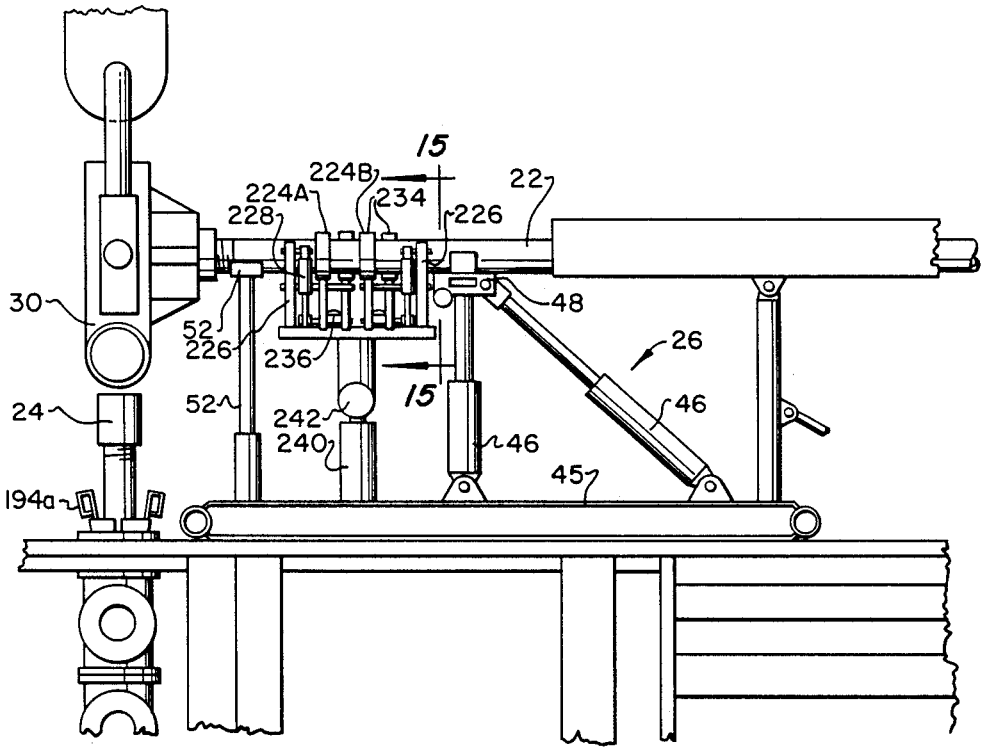
FIG. 13 is a side elevational view of a rotary drive swivel unit and an automated drill pipe handling device for automated make up with a drill pipe in accordance with the present invention.
Figure 14:
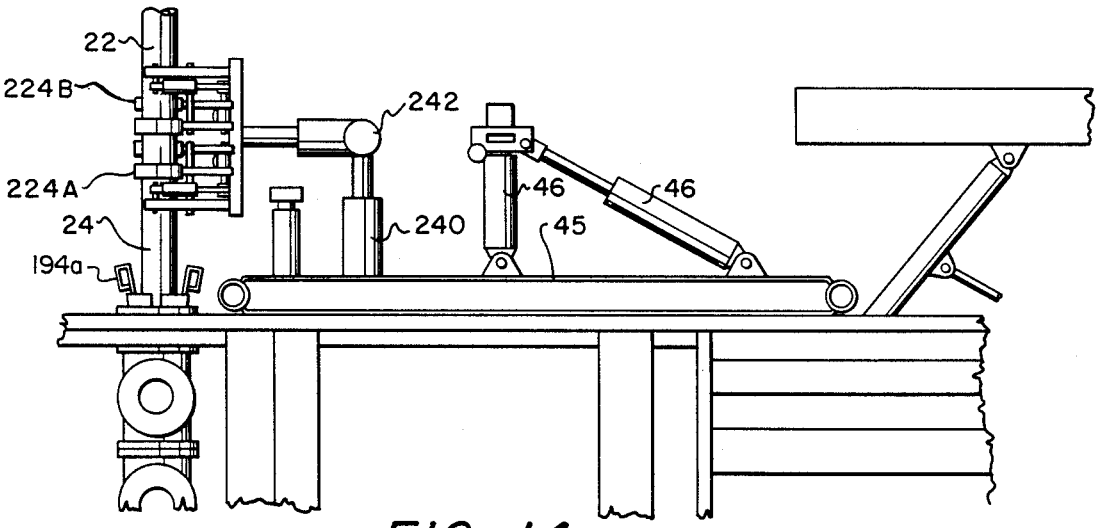
FIG. 14 is a side elevational view of an automated drill pipe handling device during make up of a drill pipe to a drill stem.

The present invention uses two power wrenches, designated power wrenches 224A and 224B in FIGS. 13 and 14. In these embodiments, wrench base 226 connects both the power wrenches to pipe handling device 26 by connection to the ram arm of hydraulic cylinder 240.

Similar to pipe handling device 26 of previously described embodiments, this embodiment supports drill pipe 22 upon a collar 48 which is connected to base 45 by hydraulic cylinders 46. Also, power output 31 of power swivel unit 30 is supported upon base 45 through collar 54 on hydraulic cylinder 52.

When the drill pipe and power output shaft align for make up by pipe handling device 26, power wrench 224A is in position to grip the power output shaft adjacent the make up and power wrench 224B is in position to grip the end of drill pipe 222 for make up.

Power wrenches 224A and 224B are then caused to simultaneously grip the power output shaft and the drill pipe, respectively, and wrenching cylinders 228 are driven to impart relative rotational motion between the power output shaft and the drill pipe for make up. This wrenching action as described with respect to FIG. 15 above continues until a tight joint is made up. Jaws 234 then release the made up joint and drill pipe 22 is lifted and suspended from power swivel drive unit 30.

Cylinder 240 is provided with a power wrench cylinder pivot which reorients first and second power wrenches to engage drill string 24 and the other end of drill pipe 22, respectively. The power wrenches are then again operated to impart relative rotation, this between time drill pipe 22 and drill string 24 in order to achieve a tight make up.

Conventional means may be used to operate gripping cylinders 236 and wrenching cylinder 228 from a central control panel such as is illustrated in the embodiment of FIG. 1 as control panel 38.

The embodiment of pipe handling device 26 illustrated in FIGS. 13, 14 and 15 permits increased torque for make up without requiring that power drive swivel unit 30 be sized greater than that power necessary for drilling operations. Further, such a pipe handling device eliminates the need for tongs 194 disclosed in FIG. 10 to be included in the slips 194A.

Although the illustrations discussed above refer to drilling oil wells, the present method and apparatus for rotary power driven swivel drilling is applicable for reworking an existing well and other well working purposes and such uses are within the scope of the present invention. Equivalent equipment which is well known in the art is substituted in these alternative drilling operations for analogous drilling equipment. Thus casing is placed downhole by substituting casing for the drill pipe in the disclosed operations of the preferred embodiment. Similarly workover operations substitute lighter weight drill pipe called tubing and the initial drill pipe used in drilling operations substitute a special heavier drill pipe which places weight on the bit.

Other modification, changes, and substitutions are intended in the foregoing disclosure and in some instances some features of the invention will be employed without a corresponding use of other features. Accordingly, it is appropriate that the appended claims be construed broadly and in the manner consistent with the spirit and scope of the present invention.

I claim:

1. A drill pipe handling device for aligning an output shaft of a rotary powered drive system with a drill pipe for make up in a substantially horizontal orientation, said drill pipe handling device including:

a base;

a first power actuated shaft attached to said base;

an output shaft receiving collar on said first power actuated shaft;

first sensor means for delivering the orientation of the output shaft resting within said output shaft receiving collar and generating a first signal that is a function of that orientation;

a second power actuated shaft attached to said base;

a drill pipe receiving collar on said second power actuated shaft;

sensor means for determining the orientation of the drill pipe resting within drill pipe receiving collar and generating a second signal that is a function thereof;

alignment means for controlling the extension and contraction of the first and second power actuated shafts;

means for comparing the first signal to the second signal and controlling the alignment means to bring the drill pipe and output shaft into alignment for make up;

said first and second power actuated shafts comprising first and second hydraulic cylinders respectively, each rigidly and orthogonally mounted to the base; and said first sensor means including:

a first sensor in contact with the output shaft adjacent to the first power actuated shaft and disposed for vertical displacement as a function of the orientation of the output shaft;

means for generating a first sensor signal as a function of the vertical displacement of the first sensor;

a second sensor in contact with the output shaft which is adjacent to the first power actuated shaft and spaced from the first sensor, said second sensor being disposed for vertical displacement as a function of the orientation of the output shaft;

means for generating a second sensor signal as a function of the vertical displacement to the second sensor; and means for comparing the first sensor signal with the second sensor signal in generating a first signal which is a function of the angular orientation of the output shaft with respect to the horizontal.

2. A drill pipe handling device constructed in accordance with claim 1 wherein the second sensor means includes:

a third sensor in contact with the drill pipe adjacent the second power actuated shaft and disposed for vertical displacement as a function of the orientation of the drill pipe;

means for generating a third sensor signal as a function of the vertical displacement of the third sensor;

a fourth sensor in contact with the drill pipe which is adjacent the second power actuated shaft and spaced from the third sensor, said fourth sensor being disposed for vertical displacement as a function of the orientation of the drill pipe;

means for generating a fourth sensor signal as a function of the vertical displacement of the fourth sensor; and means for comparing the third sensor signal with the fourth sensor signal and generating a second signal which is a function of the angular orientation of the drill pipe with respect to the horizontal.

3. A drill pipe handling device constructed in accordance with claim 2 wherein means for comparing the first signal to the second signal is a summing device.

4. A drill pipe handling device constructed in accordance with claim 3 wherein the alignment means adjust the relative height of the output shaft receiving collar and the drill pipe receiving collar by extending and contracting the first and second power actuated shafts, respectively.

* * * * *